United States Patent [19]

Slavik et al.

[11] 4,322,073

[45] Mar. 30, 1982

[54] ELECTRONIC GAME APPARATUS

[75] Inventors: William H. Slavik, Palos Hills; John V. Moravec, Willow Springs, both of Ill.

[73] Assignee: Nuvatec/Inc., Lombard, Ill.

[21] Appl. No.: 955,256

[22] Filed: Oct. 27, 1978

[51] Int. Cl.[3] ..... A63F 9/00

[52] U.S. Cl. ..... 273/16 C

[58] Field of Search ..... 273/1 E, 85 G, 237, 273/138 A, DIG. 28

[56] References Cited

U.S. PATENT DOCUMENTS

| | | | |
|---|---|---|---|
| 3,503,608 | 3/1970 | Ylinen | 273/1 E |
| 3,770,269 | 11/1973 | Elder | 273/138 A X |
| 4,017,072 | 4/1977 | Kurtz | 273/237 X |
| 4,026,555 | 5/1977 | Kirschner et al. | 273/85 G |
| 4,060,242 | 11/1977 | Huang et al. | 273/138 A X |
| 4,095,785 | 6/1978 | Conner et al. | 273/1 E |
| 4,114,882 | 9/1978 | Mau | 273/85 G |
| 4,162,792 | 7/1979 | Chang et al. | 273/85 G |
| 4,249,735 | 2/1981 | Bromley | 273/85 G |

OTHER PUBLICATIONS

*Popular Electronics;* "Build the LED Target Game"; Jun., 1977; pp.50–52.

*Radio & Electronics Constructor;* "The Tantalizer–An Electronic Game"; Oct., 1975; pp. 146–147.

*Electronics Australia;* Mar., 1976; pp. 40, 41, 43, 45.

*Primary Examiner*—Vance Y. Hum

*Assistant Examiner*—Leo Picard

*Attorney, Agent, or Firm*—Hume, Clement, Brinks, Willian & Olds, Ltd.

[57] ABSTRACT

A game apparatus is disclosed having a one-dimensional array of LED's which are sequentially activated in first and second sweep sequences which proceed toward first and second goal indicators, respectively. First and second buttons are provided which operate to reverse the first and second sequences, respectively, and the object of the game is for each player to operate his button before the appropriate sweep sequence causes his goal indicator to be activated. The rate of each sweep is variable and a player can select a higher sweep rate for his opponent by delaying his reaction until a relatively later time in the sweep sequence. The score is displayed on the same indicators as are used to play the game, and successively higher scores correspond in sequence to the sequence in which the indicators are activated during play.

9 Claims, 4 Drawing Figures

FIG. 1
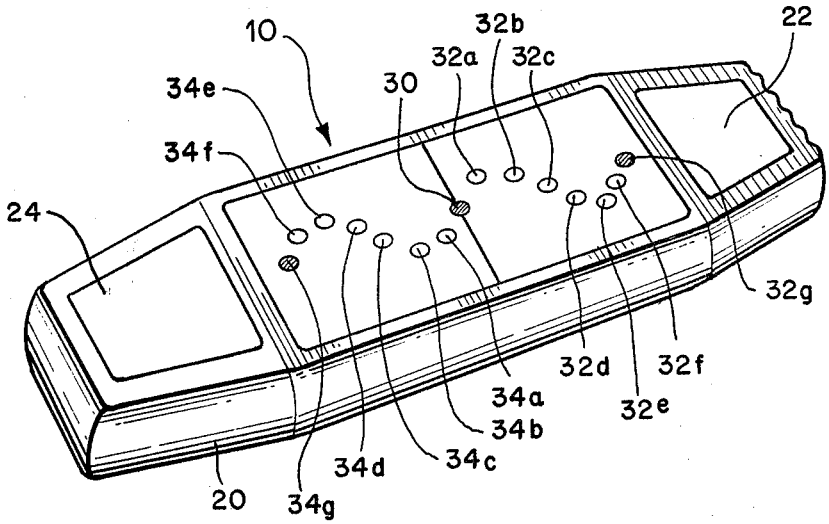
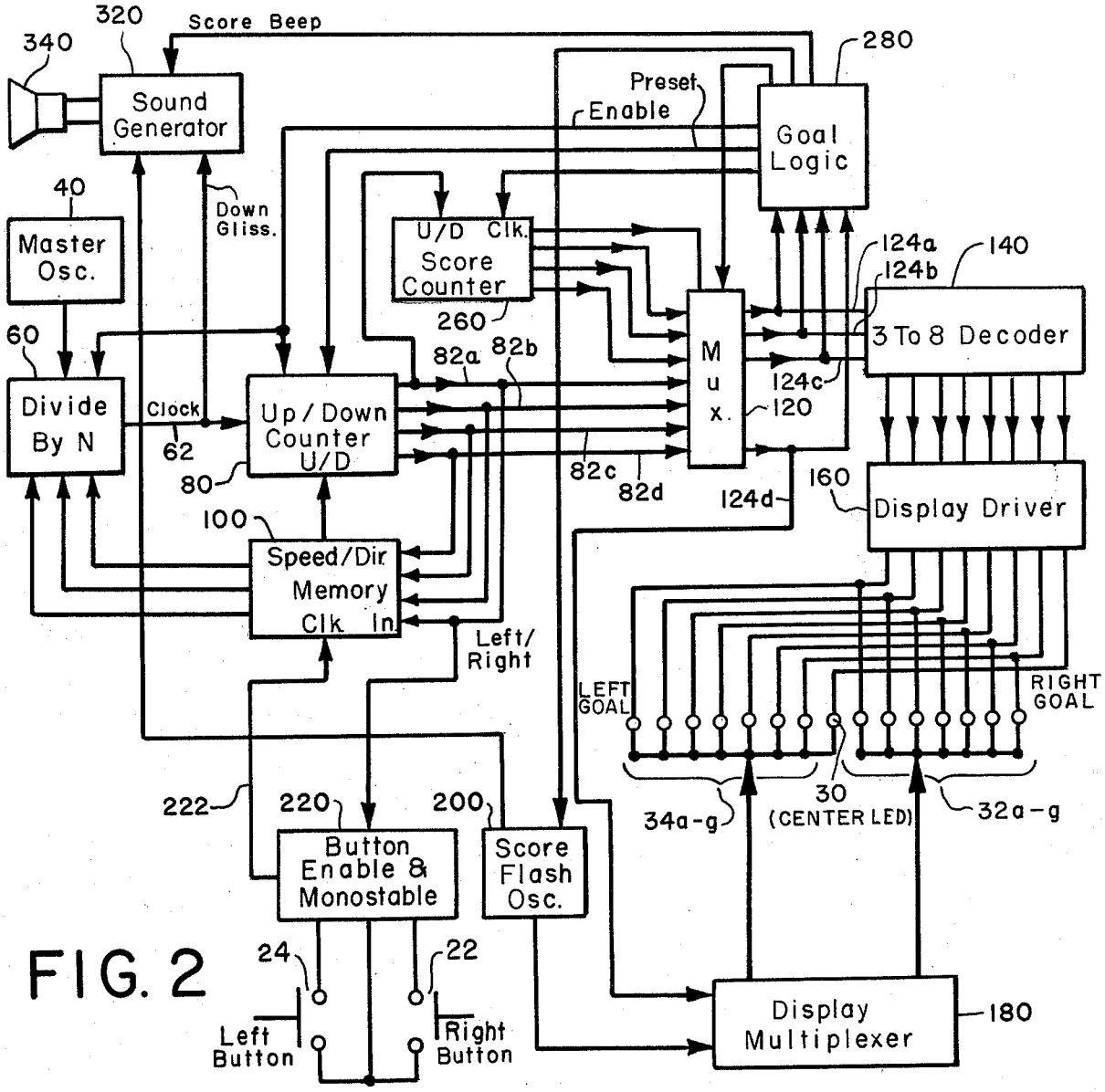
FIG. 2

ELECTRONIC GAME APPARATUS

BACKGROUND AND SUMMARY OF THE INVENTION

The present invention is directed to a novel game apparatus which can be used by one or more players in a game of skill that rewards quick reflexes on the part of the players.

The game of this invention includes an array of indicators such as lamps or LED's. Sweep means are provided for selectively activating individual indicators in two sequences: a first sequence which proceeds from a first section of the array to a second section, and a second sequence which proceeds in the reverse direction from the second to the first sections of the array.

A preferred embodiment of the invention provides two manually operated switches coupled to means for altering the operation of the sweep means. The first switch acts to terminate the first sequence and to initiate the second sequence while the second switch has a complementary effect. That is, it terminates the second sequence and initiates the first sequence. This embodiment of the invention is intended for use by two players, each operating one of the two switches.

In this embodiment the object of the game is for each player to operate his switch before the sweep means activates a predetermined indicator. That is, the first player attempts to activate the first switch before a first goal indicator is activated in the first sweep sequence and the second player attempts to activate the second switch before a second goal indicator is activated in the second sweep sequence. If either player fails to operate his switch in time, he loses the point.

One feature of the game of the present invention is that means are provided for selecting the rate at which indicators are activated by the sweep means. The selecting means operates to select a first sweep rate when the first switch is operated before a predetermined point in the sweep sequence and a second, higher sweep rate when the first switch is operated after said predetermined point. Thus, a player can select a higher sweep rate for his opponent for delaying his reaction until a relatively later time in the sweep sequence. This feature adds a further element of skill and tactics to the game.

A second feature of this invention is a novel means for displaying a score which requires no additional indicators. According to this feature of the invention the same indicators which are used to play the game are used to display the score. Score display means are provided which selectively activate at least one of the indicators to display a score. The position of the activated indicator indicates the score, and successively higher scores correspond in sequence to the sequence in which the indicators are activated by the sweep means.

In one preferred embodiment, the score is defined as the difference between the number of points scored by two players. This score is indicated by the position of an activated indicator. Thus, a zero difference is indicated by activation of a center LED, and high scores for either of the two players correspond to activated indicators near the two ends of the array, respectively. It should be noted that in this embodiment the score display can be thought of as following the general outline of the game itself. That is, in the game each player operates his switch so as to prevent the successive sweep of indicators from reaching his goal indicator. Similarly, each player attempts to prevent the score from reaching a sufficiently high difference to activate his goal indicator.

The game apparatus of the present invention can be embodied in electronic circuitry which is compact, reliable, and relatively inexpensive to manufacture. Furthermore, the foregoing features of the invention provide a game which will entertain players of varying ages. The invention itself, together with further objects and attendant advantages, will be best understood by reference to the following descriptions taken in connection with the accompanying drawings.

BRIEF DESCRIPTION OF THE DRAWINGS

FIG. 1 is a perspective view of a preferred embodiment of the game apparatus of this invention.

FIG. 2 is a block diagram of the game apparatus of FIG. 1.

DETAILED DESCRIPTION OF A PREFERRED EMBODIMENT

Figure 3A:
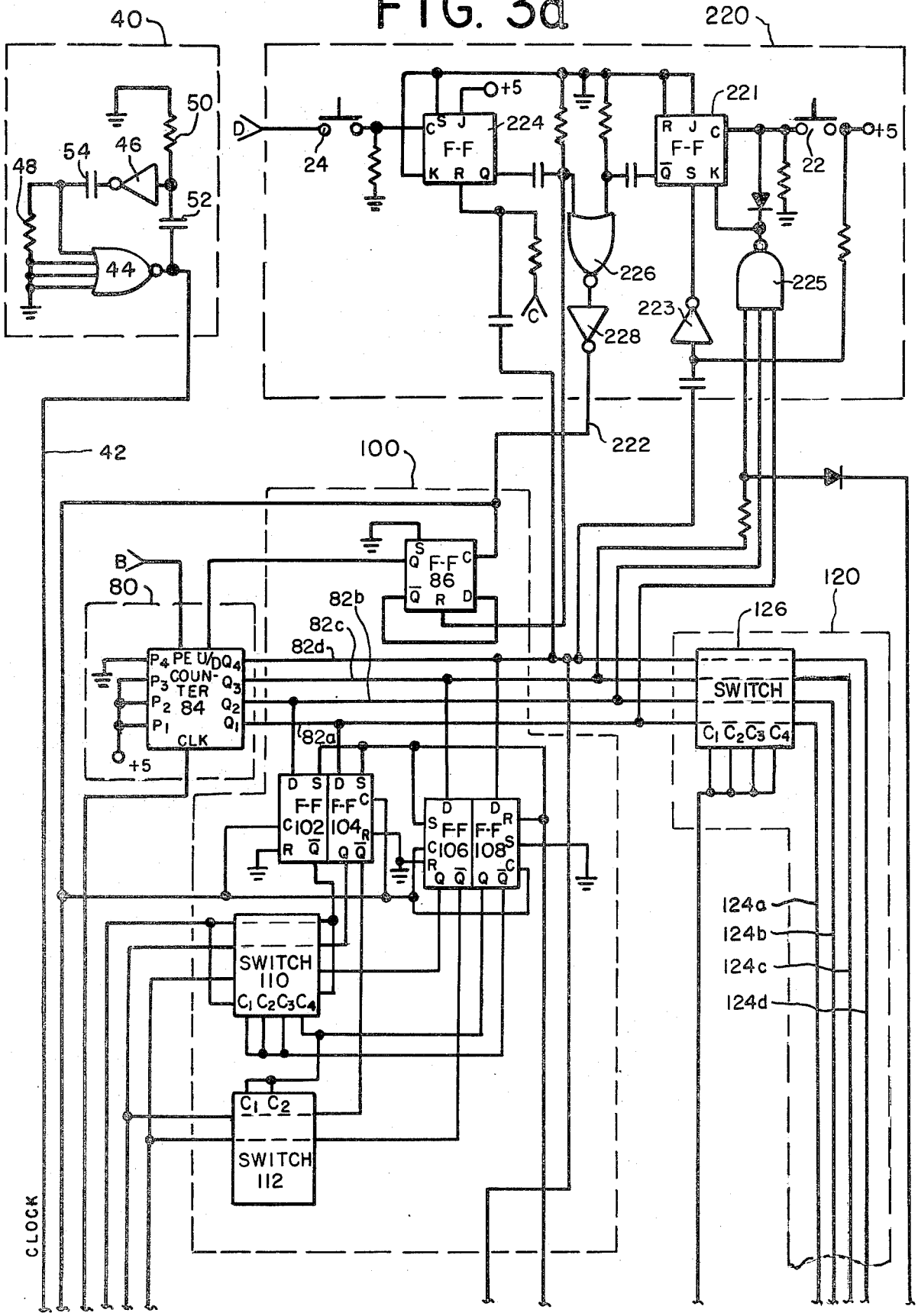
FIGS. 3*a* and 3*b* combine to form a schematic circuit diagram of the game apparatus of FIG. 1.

Referring now to the drawings, FIG. 1 shows a perspective view of a preferred embodiment 10 of the game apparatus of this invention. This embodiment 10 includes a casing 20 which includes all electronics necessary for operating the game. First and second switch means, such as buttons 22,24 are provided for controlling the activation of an array of indicators such as LED's 30, 32*a–g*, 34*a–g*. Preferably, these indicators are arranged sequentially in a one-dimensional array. As used herein, it should be understood that the term "one-dimensional" is used to denote any sequential ordering of indicators and is, therefore, not limited to arrays in which all indicators are colinear. As will be explained below, certain of the indicators have special significance in the game. Indicator 30 is the center LED and is used as a starting position. Indicators 32*g* and 34*g* are goal indicators associated with switches 22,24, respectively.

FIG. 2 presents a block diagram of the electronics of the apparatus of FIG. 1 which will be used in describing the general operation of the game apparatus. In general terms, this circuit includes sweep means for activating the LED's 30, 32*a–g*, 34*a–g* one at a time in sequence, approaching either the right goal LED 32*g* or the left goal LED 34*g*.

In this embodiment the sweep means includes a master oscillator 40 which generates a series of clock pulses which are applied as an input to a divide circuit 60. As will be explained below, the output of the divide circuit 60 has a frequency which is some fraction of the frequency of the master oscillator 40. This output of the divide circuit 60 is applied as an input to an up-down counter 80 which counts the incoming pulses (incrementing or decrementing the count as appropriate) and outputs the current count as a four bit binary number on conductors 82*a–d*. This binary number serves to identify which of the LED's 30, 32*a–g*, 34*a–g* is to be activated.

Conductors 82*a–d* are applied as inputs to a multiplexer 120 which includes output conductors 124*a–d* which can be connected to conductors 82*a–d*, respectively, by the multiplexer 120. The output conductors 124*a–c* are applied to a binary to decimal decoder 140 and the conductor 124*d* is applied to a display multiplexer 180 to select one of the LED's 30, 32*a–g*, 34*a–g* for activation. The LED's are so arranged that they are activated in sequence as the counter 80 counts up and down.

A goal logic circuit 280 is provided which monitors the output of the multiplexer 120. Whenever the binary number output by the counter 80 reaches either zero or 14, and the counter output is passed by the multiplexer 120, the goal logic circuit 80 produces several output signals. These output signals are applied to a sound generator 320 to cause a sound to be generated and sounded on a speaker 340 signalling a goal. Also, the output on line 282 is applied to the multiplexer 120 to cause a score to be displayed on LED's 30, 32*a–g*, 34*a–g* and to a score flash oscillator 200 to cause the displayed score to flash. Also, the goal logic circuit 280 resets the Divide by N circuit 60 and the counter 80 after each goal and updates the score counter 260.

The score is stored in an up-down counter 260 which counts the number of goals scored, incrementing the score for goals scored by one player and decrementing for those scored by the other player. The score counter 260 is initialized to 7 so that the center LED 30 is originally activated. In this way LED's 32*g* and 34*g* correspond to score differences of seven in favor of the first and second players, respectively. When the score reaches 7 in favor of either player the goal logic circuit 280 terminates the game, which must then be reset to resume operation.

The button enable circuit 220 is responsive to the conductor 82*d* which provides information as to whether the position counter 80 is activating an LED on the left or right side of the array. This circuit 220 operates to enable only one of the two switches 22,24 at any one time. For example, when the position counter 80 is activating a LED 32*a–g* on the right side of the array, only the right button 22 is enabled.

When an enabled button 22,24 is operated the button enable circuit 220 produces a clocking pulse on line 222. This pulse, if generated before a goal is detected by the goal detection logic 280, causes the position counter 80 to reverse its direction of counting. That is, the state of the up-down input of the position counter 80 is reversed. This causes the current sweep sequence to be terminated and a new sequence, proceeding in the reverse direction, to be initiated. Thus, by operating his button at the appropriate time a player can stop a sequence approaching his goal indicator 32*g* or 34*g* and cause a reverse sequence to be directed toward his opponent's goal indicator.

The sweep rate at which this reverse sequence proceeds is determined by the divide circuit 60. The memory circuit 100 samples and stores the output of the position counter 80 at the time of the clocking pulse on line 222. This information is processed and supplied as an input to the divide circuit 60 such that the clock rate on line 62 is lower when the button is operated while an LED near the center LED was activated and is higher when the button is operated while a LED near the goal indicators 32*g*, 34*g* is activated. This feature provides an incentive for a player to wait until a LED near his goal is activated before operating his button. Generally speaking, the longer a player waits the higher will be the sweep rate of the sequence directed at his opponent.

Figure 3B:
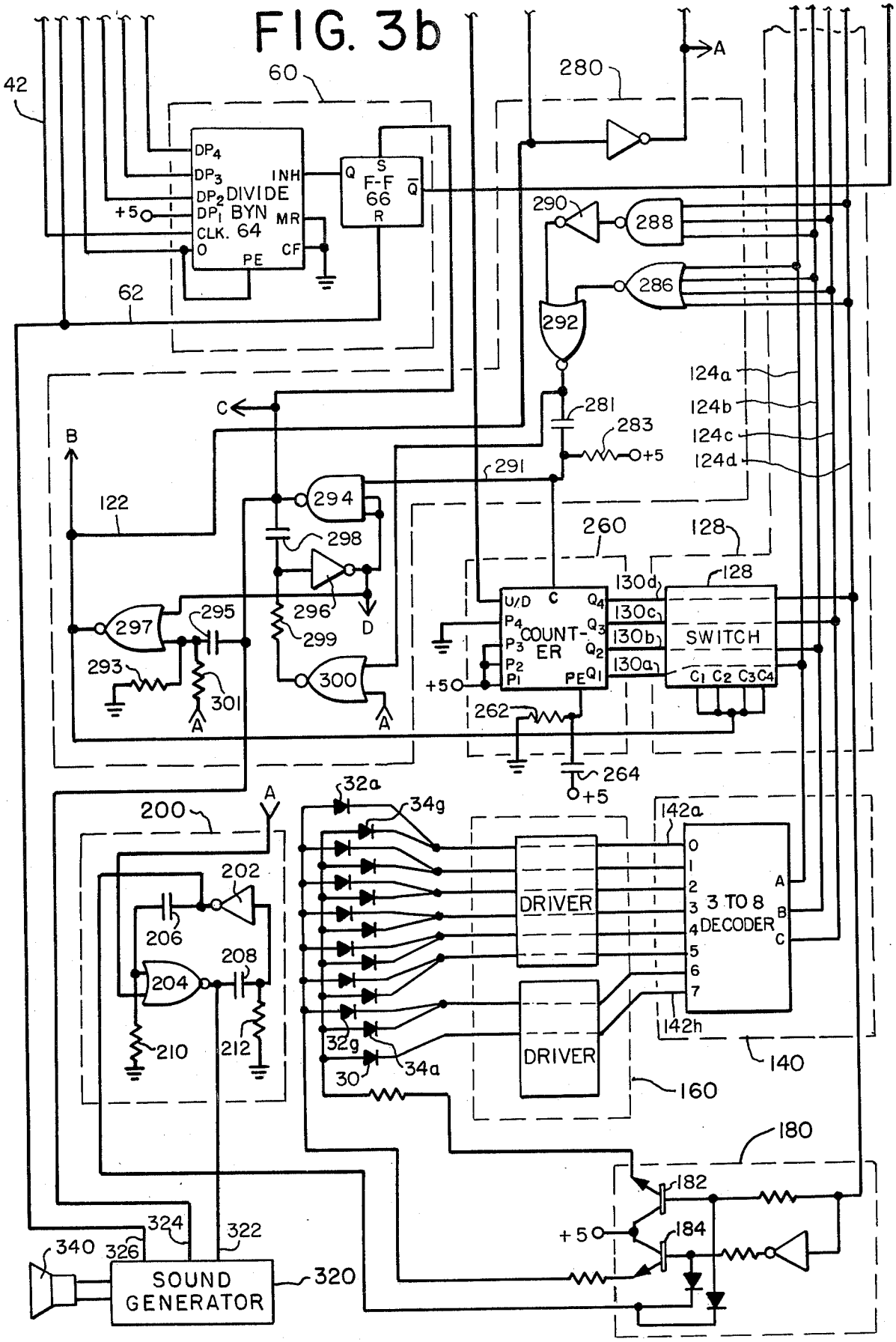

Turning now to FIG. 3, the detailed circuitry of the preferred embodiment of FIG. 1 will be described. As an aid to understanding the circuit of FIG. 3, dotted lines identified by the same reference numerals as used in FIG. 2 have been used in FIG. 3 to designate corresponding portions of the two diagrams, and the same general order of description will be used.

The master oscillator 40 is an astable multivibrator which generates a pulsed output on conductor 42. This circuit includes a NOR gate 44 and an inverting buffer 46 connected as shown. In this embodiment, 100 Kohm resistors 48,50 and 0.033 micro farad capacitors 52,54 are used to provide a clocking signal of the desired frequency.

This clocking signal on conductor 42 is applied to the clock input of a Divide by N circuit 64 such as a CMOS 4526 circuit which acts to divide the rate of the clock input by a number between 15 and 3, depending on the signals on input terminals DP2, DP3, DP4. In this embodiment DP1 is held high. The output signal of circuit 64 appears on the "O" terminal of circuit 64, and is applied to the clock input of an up-down counter 84.

The counter 84 counts the incoming pulses applied to its clock input, incrementing or decrementing the count according to the state of the up-down input of the counter 84. The binary number stored in the counter 84 at any given time is output on conductors 82*a–d*, where 82*a* is the least significant bit and 82*d* is the most significant bit. Preset inputs P1, P2, and P3 are strapped high and P4 is grounded. Counter 84 is preferably a counter such as CMOS circuit 4516.

Conductors 82*a–d* are applied as inputs to a quad analog switch 126 such as a CMOS 4016 circuit. The switch 126 acts to connect conductors 82*a–d* with conductors 124*a–d*, respectively, when control inputs C1–C4 are held high and to disconnect conductors 82*a–d* from 124*a–d* when inputs C1–C4 are held low. Similarly, a quad analog switch 128 connects and disconnects conductors 124*a–d* with conductors 130*a–d*, respectively, on command.

The conductors 124*a–c* are applied to the signal inputs of a binary to decimal decoder 140 such as a CMOS 4512 circuit which generates an output signal on one of the conductors 142*a–h* depending on the status of the input conductors 124*a–c*. Output signals on conductors 142*a–h* are separately amplified by the drivers 160 which preferably are a National Semiconductor 75492 circuit, and then transmitted to LED's 30, 32*a–g* and 34*a–g*. Each output 142*a–g* of the decoder 140 drives two LED's 32*a–g* and 34*a–g*, respectively. Output 142*h*, corresponding to an octal number of 7 on the conductors 124*a–c*, drives the center LED 30. The display multiplexer 180 determines whether an LED on the left side 34*a–g* or an LED on the right side 32*a–g* will be activated by the output of the decoder 140, according to the signal on line 124*d*. Depending on the voltage on line 124*d*, one of the two transistors 182,184 will be activated, thereby supplying voltage to one of the two sets of LED's as shown. Thus, the display multiplexer 180 cooperates with the decoder 140 and the drivers 160 to activate only one LED 30, 32*a–g*, 34*a–g* at any one time, according to the signals on lines 124*a–c*.

The goal logic circuit is identified by reference numeral 280. A NOR gate 286 is connected to lines 124*a–d* to generate a high output whenever all four of the lines 124*a–d* go low, corresponding to activation of the goal indicator LED 34*g*. A NAND gate 288 is connected to lines 124*b–d* to generate a low output whenever these three lines go high, corresponding to activation of the goal indicator LED 32*g*. The output of the NAND gate 288 is inverted by a buffer 290 and the outputs of both the buffer 290 and the NOR gate 286 are applied as inputs to a NOR gate 292. The output of NOR gate 292 is coupled via a 0.03 microfarad capacitor 281 to line 291 which is also coupled to +5 volts via a 1 megohm resistor 283. The signal on line 291 goes low immediately following detection of a goal by NOR gate 286 or NAND gate 288, and high at other times.

The output of the NOR gate 292 on line 291 is used to control the score counter 260 as well as the quad switches 126,128. As mentioned, the signal on line 291 goes low on detection of a goal. This signal is supplied as an input to a monostable multivibrator made up of a NAND gate 294, an inverting buffer 296, a resistor 299, and a capacitor 298. When the signal on line 291 goes low the output of the NAND gate 294 goes high. This causes the output of the inverting buffer 296 to go low until the capacitor 298 is discharged through resistor 299, at which time the output of the buffer 296 goes high again. As will be explained below, the capacitor 298 discharges only when the output of the end of game detecting NOR gate 300 is low. In this embodiment a 510 Kohm resistor 299 and a 1 microfarad capacitor 298 are used to provide the desired timing.

One input of the NOR gate 297 is coupled via a capacitor 295 to the output of the NAND gate 294, and when the output of the NAND gate 294 goes high, this input goes high as well. The other input of the NOR gate 297 is connected to the output of the buffer 296, which goes low shortly after detection of a goal. Thus, the output of the NOR gate 297 is low prior to detection of a goal (when the output of buffer 296 is high) and immediately after detection of a goal (when capacitor 295 is charged by the output of NAND gate 294). However, resistor 293 discharges capacitor 295, and a short time after goal detection both inputs to NOR gate 297 go low, and the output of NOR gate 297 goes high. The input of the buffer 296 is connected to the output of a NOR gate 300 which serves to detect the end of game. The inputs of the NOR gate 300 are connected to the output of the NOR gate 292 and the inverted output of the NOR gate 297.

The output of NOR gate 297 is used to control the quad switches 126,128 via line 122. When the signal on line 122 goes low, switch 126 is turned on and switch 128 is turned off so that lines 82*a–d* are connected to lines 124*a–d*, respectively. When the signal on line 122 is high, switch 126 is turned off and switch 128 is turned on so that lines 130*a–d* are connected to lines 124*a–d*, respectively. Thus, following a goal the goal is displayed for a period of time after which time the score is displayed. The goal logic 280 then causes the switches 126,128 to revert to the play configuration in which the output of the counter 84 is displayed on the LED's.

The score is generated and stored in an up-down counter 260 such as a CMOS 4516 circuit. The outputs Q1–Q4 of the counter 260 are connected to the lines 130*a–d*, respectively. The counter 260 is clocked by the output of the NOR gate 292, and preset inputs P1–P3 are tied high while P4 is grounded. The up-down input is connected to line 82*d* such that the count is decremented when a goal is detected while line 82*d* is low and incremented when a goal is detected while line 82*d* is high. Finally, the preset enable terminal of counter 260 is tied to ground via a resistor 262 and to system power via a capacitor 264. This arrangement ensures that the counter 260 is present to 7 (the center LED 30) whenever power is applied to the game.

The button enable circuit is indicated by reference numeral 220. The right button 22 clocks a right flip flop 221 and the left button 24 clocks a left flip flop 224. Both flip flops 221,224 are preferably CMOS 4027 circuits. The right flip flop 221 is connected with its J and R inputs grounded, its $\overline{Q}$ connected via a capacitor to a first input of a NOR gate 226, and its S and K inputs connected to ensure proper enabling of the button 22. The S input is connected to an inverting buffer 223 which is driven by line 82*d*. Buffer 223 sets $\overline{Q}$ low whenever the signal on line 82*d* falls from high to low, thereby disabling the button 22.

The left flip flop 224 is connected with its S and K inputs grounded, its J input held high, its Q output connected via a capacitor to a second input of the NOR gate 226. The R input is connected via a capacitor to line 82*d* and via a resistor to point C, the output of the NAND gate 294. Flip flop 224 is reset when the signal on line 82*d* goes high and after detection of a goal, thereby disabling the button 24.

When an enabled button is pushed the appropriate output of the enabled flip flop 221,224 goes high and the output of the NOR gate 226 goes from high to low. This causes the output of the inverting buffer 228 to go from low to high, an event which has several effects.

First, the flip flop 66 is reset, thereby ensuring that the divider is not inhibited and that a clocking pulse is supplied to the counter 84. Second, the flip flop 86 is clocked to reverse the up-down counter 84 from up to down, or vice versa. This causes the direction of the sweep of the LED's to be reversed. Third, a clock pulse is applied to four flip flops 102, 104, 106, 108, which are used as latches, one for each of the lines 82*a–d*. Thus, the state of the lines 82*a–d* at the instant of the output from the button enable circuit is stored in the outputs of the flip flops 102–108.

The flip flops 102–106 are used as inputs to the quad switches 110,112, while the flip flop 108 is used to control the switches 110,112. The outputs of the switches 110,112 are connected to the inputs DP2, DP3, DP4 of the divide circuit 64 and the switches 110,112 are controlled such that the input to the divide circuit 64 is in general smaller for binary numbers encoded on lines 82*a–d* associated with LED's closer to the goal LED's 32*g*, 34*g*. In general, the closer the activated LED was to one of the goals at the time the button was pushed, the higher the number applied as an input to the DP2–DP4 inputs of divide circuit 64. In the preferred embodiment the switches 110,112 are CMOS 4016 circuits and all flip flops are CMOS 4013 circuits.

The game of this embodiment is provided with means for resetting the circuit after each goal is scored. When the output of the NOR gate 297 on line 122 goes from low to high (indicating that the score is to be displayed) the Preset Enable input of counter 84 is brought high. This resets the ball position to the center LED 30. Also, flip flops 102,104, and 106 are set and flip flop 108 is reset in order to restore the Divide by N circuit 64 inputs to the proper values.

In order to increase player interest the indicators are made to flash on and off during score display by the score flasher circuit 200. This flasher circuit is an astable multivibrator which includes an inverting buffer 202, a NOR gate 204, 1 megohm resistors 210,212, and 0.22 microfarad capacitors 206,208, connected as shown. A sound generator 320 is also provided to further increase player interest. In the preferred embodiment, this generator 320 is provided with three inputs. The signal on input 322 is associated with the score flash and causes a high frequency square wave audio signal to be generated and sounded. The signal on input 324 is associated with a goal and causes a low frequency square wave audio signal to be generated. Finally, the signal on input 326 is associated with changing ball position and causes a down ramp audio signal to be generated with each change in ball position during play.

Of course, it should be understood that various changes and modifications to the preferred embodiment described herein will be apparent to those skilled in the art. For example, it may be preferable to provide fewer numbers of LED's and sweep speeds in some applications, or the entire logic circuit may be integrated in a custom integrated circuit in order to reduce the manufacturing cost of the circuit. Such changes and modifications can be made without departing from the scope of the present invention. It is, therefore, intended that such changes and modifications be covered by the following claims.

We claim:

1. A game apparatus comprising:

switch means;

a plurality of at least three indicators arranged in an array, said array having a first section and a second section;

sweep means for sequentially activating the plurality of indicators in a first sequence which proceeds from the first section to the second section and a second sequence which proceeds from the second section to the first section;

means, responsive to the switch means, for altering the operation of the sweep means to terminate the sequential activation of the plurality of indicators in the first sequence upon operation of the switch means, and to initiate the sequential activation of the plurality of indicators in the second sequence;

means for automatically selecting the rate at which indicators are sequentially activated in the second sequence, said selecting means operating to select a first rate when the switch means is operated before a predetermined point of the first sequence, and a second rate when the switch means is operated after said predetermined point in the first sequence, wherein the second rate is faster than the first rate.

2. The game apparatus of claim 1 further including means for selectively activating at least one of the indicators to display a score wherein the position of the activated indicators indicates the score and further, wherein successively higher scores correspond in sequence to the first sequence in which indicators are activated by the sweep means.

3. The game apparatus of claim 1 or 2 wherein the array is a one-dimensional array.

4. The game apparatus of claim 1 or 2 further including score keeping means for revising the score when the sweep means completes the first sequence prior to operation of the switch means.

5. A game apparatus comprising:

first and second switch means;

a plurality of at least three indicators arranged in a one-dimensional array having first and second goal positions;

sweep means for alternately activating the plurality of indicators in a first sequence which progresses toward the first goal position and a second sequence which progresses toward the second goal position;

first means, responsive to the first switch means for terminating the first sequence and initiating the second sequence on operation of the first switch means;

second means, responsive to the second switch means, for terminating the second sequence and initiating the first sequence on operation of the second switch means;

means for automatically selecting the sweep rate at which indicators are sequentially activated in the second sequence in response to the point at which the first sequence is terminated by the first means, said selecting means operating to select a first sweep rate when the first sequence is terminated at a first point in the array and a second, higher sweep rate when the first sequence is terminated at a second point in the array nearer the first goal position than the first point;

score keeping means for maintaining a score and revising the score when the sweep means completes the first sequence prior to operation of the first switch means and when the sweep means completes the second sequence prior to operation of the second switch means; and score display means for activating at least one of the plurality of indicators to display the score, wherein the position of the activated indicators indicates the score, and further, wherein progressively higher scores correspond to indicators situated progressively closer to the first and second goal positions.

6. A game apparatus comprising:

a first switch controllable by a first player;

a second switch controllable by a second player;

a plurality of indicators arranged in a one-dimensional array, said plurality of indicators including a first goal indicator and a second goal indicator;

sweep means for alternately activating the plurality of indicators in a first sequence which progresses toward the first goal indicator and a second sequence which progresses toward the second goal indicator;

first means, responsive to the first switch, for terminating the first sequence and initiating the second sequence on operation of the first switch;

second means, responsive to the second switch, for terminating the second sequence and intiating the first sequence on operation of the second switch;

first means for automatically selecting the sweep rate at which indicators are sequentially activated in the second sequence in response to the point in the preceding first sequence at which the first sequence is terminated by the first terminating means, said first selecting means operating to select a first sweep rate when the first sequence is terminated at a first point in the array, and a second sweep rate, higher than the first sweep rate, when the first sequence is terminated at a second point in the array, nearer the first goal indicator than the first point;

second means for automatically selecting the sweep rate at which indicators are sequentially activated in the first sequence in response to the point in the preceding second sequence at which the second sequence is terminated by the second terminating means, said second selecting means operating to select a third sweep rate when the second sequence is terminated at a third point in the array, and at a fourth sweep rate, higher than the third sweep rate, when the second sequence is terminated at a fourth point in the array, nearer the second goal indicator than the third point.

7. The game apparatus of claim 6 wherein the first sweep rate is substantially equal to the third sweep rate, the second sweep rate is substantially equal to the fourth sweep rate, the first goal indicator is symmetrically positioned in the array with respect to the second goal indicator, the first point is symmetrically positioned in the array with respect to the third point; and the second point is symmetrically positioned in the array with respect to the fourth point.

8. The game apparatus of claims 6 or 7 further including:

score keeping means for maintaining a score and revising the score when the sweep means completes the first sequence prior to operation of the first switch and when the sweep means completes the second sequence prior to operation of the second switch; and means for selectively activating at least one of the indicators to display the score, wherein the position of the at least one activated indicator represents the score, and further, wherein successively higher scores for the first player correspond in sequence to the second sequence in which indicators are activated by the sweep means and successively higher scores for the second player correspond in sequence to the first sequence in which indicators are activated by the sweep means.

9. The game apparatus of claim 1 or 5 or 6 wherein the plurality of indicators comprises 15 indicators.

* * * * *